US011079138B2

(12) United States Patent
Suzuki

(10) Patent No.: US 11,079,138 B2
(45) Date of Patent: Aug. 3, 2021

(54) COMBUSTION APPARATUS

(71) Applicant: Rinnai Corporation, Nagoya (JP)

(72) Inventor: Yosuke Suzuki, Nagoya (JP)

(73) Assignee: Rinnai Corporation, Nagoya (JP)

( * ) Notice: Subject to any disclaimer, the term of this patent is extended or adjusted under 35 U.S.C. 154(b) by 351 days.

(21) Appl. No.: 15/736,847

(22) PCT Filed: Jul. 8, 2016

(86) PCT No.: PCT/JP2016/070268
§ 371 (c)(1),
(2) Date: Dec. 15, 2017

(87) PCT Pub. No.: WO2017/014073
PCT Pub. Date: Jan. 26, 2017

(65) Prior Publication Data

US 2018/0163994 A1 Jun. 14, 2018

(30) Foreign Application Priority Data

Jul. 17, 2015 (JP) ..... JP2015-142948

(51) Int. Cl.
*F24H 9/20* (2006.01)
*F23N 3/08* (2006.01)
(Continued)

(52) U.S. Cl.
CPC ..... *F24H 9/2035* (2013.01); *F23N 3/08* (2013.01); *F23N 5/02* (2013.01); *F23N 5/20* (2013.01);
(Continued)

(58) Field of Classification Search
CPC ... F24H 1/00; F24H 1/14; F24H 1/145; F24H 9/2035; F23N 3/08; F23N 5/02;
(Continued)

(56) References Cited

U.S. PATENT DOCUMENTS 2,274,341 A * 2/1942 Mueller ..... 237/55
4,145,180 A * 3/1979 Bendorf ..... F23N 5/123 431/46
(Continued)

FOREIGN PATENT DOCUMENTS

JP 07-004649 1/1995
JP 08-193752 7/1996
(Continued)

OTHER PUBLICATIONS

JPO English abstract of JP 11101449, attached as "JP11101449_abstract.pdf" (Year: 1999).*
(Continued)

*Primary Examiner* — Avinash A Savani
*Assistant Examiner* — Martha M Becton
(74) *Attorney, Agent, or Firm* — Amin, Turocy & Watson, LLP

(57) ABSTRACT

A combustion apparatus (1) has a burner (11) configured to burn combustion gas, a heat exchanger (12) disposed below the burner (11), and a combustion fan (13) configured to supply air for combustion, wherein the combustion apparatus performs post-purge operation in which the combustion fan (13) is activated for a predetermined period of time after combustion operation of the burner (11) stops, and intermittent blower operation in which activation and deactivation of the combustion fan (13) is repeated a plurality of times at predetermined intervals after the post-purge operation ends.

4 Claims, 9 Drawing Sheets

(51) Int. Cl.
*F23N 5/02* (2006.01)
*F24H 1/14* (2006.01)
*F23N 5/20* (2006.01)
*F23N 5/24* (2006.01)

(52) U.S. Cl.
CPC ..... *F23N 5/203* (2013.01); *F23N 5/24* (2013.01); *F24H 1/14* (2013.01); *F24H 1/145* (2013.01); *F23N 2223/04* (2020.01); *F23N 2223/22* (2020.01); *F23N 2227/02* (2020.01); *F23N 2227/06* (2020.01); *F23N 2227/10* (2020.01); *F23N 2233/08* (2020.01)

(58) Field of Classification Search
CPC ... F23N 5/20; F23N 5/203; F23N 5/24; F23N 2023/04; F23N 2023/22; F23N 2027/02; F23N 2027/06; F23N 2027/10; F23N 2033/08
See application file for complete search history.

(56) References Cited

U.S. PATENT DOCUMENTS 4,436,506 A * 3/1984 Berkhof ..... F23N 5/006 236/15 E
4,547,144 A * 10/1985 Dietiker ..... F23N 1/067 236/15 BD
4,638,942 A * 1/1987 Ballard ..... F23N 1/002 236/10
4,695,246 A * 9/1987 Beilfuss ..... F23N 5/203 126/116 A
4,738,307 A * 4/1988 Bentley ..... F28D 9/0031 165/133
4,768,947 A * 9/1988 Adachi ..... F23N 1/022 122/14.21
4,815,524 A * 3/1989 Dempsey ..... F23N 5/203 165/245
4,848,314 A * 7/1989 Bentley ..... F28F 19/04 126/116 R
4,850,310 A * 7/1989 Wildgen ..... F23N 1/002 122/446
4,887,767 A * 12/1989 Thompson ..... F23N 1/002 236/1 EB
4,913,128 A * 4/1990 Adachi ..... F23N 1/022 122/14.21
4,976,459 A * 12/1990 Lynch ..... F23N 1/022 236/1 EB
4,982,721 A * 1/1991 Lynch ..... F23N 1/022 126/116 A
4,994,959 A * 2/1991 Ovenden ..... F23N 1/022 236/15 BD
5,027,789 A * 7/1991 Lynch ..... F23N 1/022 126/116 A
5,186,386 A * 2/1993 Lynch ..... F23N 5/203 236/11
5,197,664 A * 3/1993 Lynch ..... F23N 5/242 126/116 A
5,271,556 A * 12/1993 Helt ..... F23N 5/203 236/11
5,313,930 A * 5/1994 Kujawa ..... F24H 9/12 126/110 R
5,341,795 A * 8/1994 Chou ..... F24H 3/065 126/110 R
5,346,001 A * 9/1994 Rieke ..... F24H 3/105 165/170
5,379,749 A * 1/1995 Rieke ..... F24H 8/006 126/110 R
5,379,750 A * 1/1995 Larsen ..... F24H 9/1881 126/110 R
5,379,751 A * 1/1995 Larsen ..... F24H 9/148 126/110 R
5,437,263 A * 8/1995 Ellingham ..... F24H 3/105 126/110 AA
5,623,918 A * 4/1997 Swilik, Jr. ..... F04D 29/4226 126/110 R
5,658,140 A * 8/1997 Kondou ..... F23N 3/082 431/90
5,704,343 A * 1/1998 Ahn ..... F24H 8/006 126/110 R
5,713,515 A * 2/1998 Adams ..... F23N 1/082 165/256
5,749,355 A * 5/1998 Roan ..... F24H 8/00 126/110 R
5,799,646 A * 9/1998 Zia ..... F23C 3/002 126/110 AA
5,819,721 A * 10/1998 Carr ..... F24H 9/2085 126/116 A
5,902,099 A * 5/1999 Rowlette ..... F23N 5/123 126/116 A
5,984,003 A * 11/1999 Butler ..... F24D 19/1087 126/116 A
5,997,280 A * 12/1999 Welz, Jr. ..... F23N 1/022 431/31
6,059,195 A * 5/2000 Adams ..... F23N 5/203 236/20 R
6,129,284 A * 10/2000 Adams ..... F23N 5/203 236/21 R
6,161,535 A * 12/2000 Dempsey ..... F24H 9/0036 126/110 R
6,247,919 B1 * 6/2001 Welz, Jr. ..... F23N 1/022 137/554
6,283,115 B1 * 9/2001 Dempsey ..... F24H 9/0036 126/110 R
6,382,203 B1 * 5/2002 Kim ..... F04D 25/166 126/110 R
6,390,806 B1 * 5/2002 Dempsey ..... F23D 14/045 431/21
6,497,570 B1 * 12/2002 Sears ..... F23C 5/02 126/110 R
6,764,298 B2 * 7/2004 Kim ..... F23D 14/60 431/12
6,866,202 B2 * 3/2005 Sigafus ..... F23N 1/002 236/11
7,036,498 B2 * 5/2006 Riepenhoff ..... F24H 8/006 126/110 R
7,100,597 B2 * 9/2006 Rand ..... F24H 3/0488 126/110 R
8,056,553 B2 * 11/2011 Khan ..... F24H 8/006 126/116 R
8,294,393 B2 * 10/2012 Schock ..... F04D 27/001 318/280
8,362,736 B2 * 1/2013 Woodward ..... H02P 4/00 318/772
8,362,737 B2 * 1/2013 Woodward ..... H02P 25/18 318/772
8,487,580 B2 * 7/2013 Woodward ..... H02P 1/16 318/772
8,925,541 B2 * 1/2015 Thompson ..... F23N 1/102 126/99 R
9,651,268 B2 * 5/2017 Branson ..... F24D 12/02
9,863,636 B2 * 1/2018 Farley ..... F24D 19/1084
10,215,425 B2 * 2/2019 Branson ..... F24D 19/1087
2005/0126558 A1 * 6/2005 Riepenhoff ..... F24H 8/006 126/110 R
2005/0263148 A1 * 12/2005 Rand ..... F24H 3/0488 126/110 R
2016/0047548 A1 * 2/2016 Farley ..... F23N 5/242 126/116 A

FOREIGN PATENT DOCUMENTS

JP 11-101449 4/1999
JP 11-173551 6/1999
JP 11-182933 7/1999
JP 2001-004136 1/2001
JP 2001-215213 8/2001

(56) References Cited

FOREIGN PATENT DOCUMENTS

| | | |
|---|---|---|
| JP | 2008-002701 | 1/2008 |
| JP | 2013-242096 | 12/2013 |

OTHER PUBLICATIONS

ICM 253 Post Purge Timer, attached as "ICM_253_post_purge_timer_with_motivation_v3.pdf" (Year: 2015).*

"ICM253 Fan Blower Control—Off Delay on Break (12-390 Second Adjustable Delay)" from SupplyHouse.com, included as "ICM253_Fan_BlowerCtrl_supplyhouse.pdf" and online at https://www.supplyhouse.com/ICM-Controls-ICM253-ICM253-Fan-Blower-Control-Off-Delay-on-Break-12-390-Second-Adjustable-Delay (Year: 2013).*

"ICM Controls ICM253 Fan Delay Timer, 12-390 S Adjustable Off Delay" from Amazon.com, included as "ICM253_Fan_Delay_Timer.pdf" and online at https://www.amazon.ca/ICM-Controls-ICM253-12-390-Adjustable/dp/B000E24YQA (Year: 2013).*

International Search Report and Written Opinion for International Application No. PCT/JP2016/070268 dated Sep. 20, 2016, 9 pages.

International Preliminary Report on Patentability for International Application No. PCT/JP2016/070268 dated Feb. 1, 2018, 7 Pages.

* cited by examiner

COMBUSTION APPARATUS

FIELD OF THE INVENTION

The present invention relates to a combustion apparatus. Especially, the present invention relates to the combustion apparatus configured such that a burner is disposed above a heat exchanger and combustion exhaust gas generated by the burner is supplied to the heat exchanger from above.

BACKGROUND ART

In a conventional combustion apparatus such as a water heater and a heat source device for a room heater, post-purge operation is performed in which a combustion fan is continuously activated to discharge combustion exhaust gas inside a housing to the outside for a predetermined period of time even after combustion operation of a burner stops.

In this kind of the combustion apparatus, during the combustion operation, strong acid drain is generated by condensing moisture in the combustion exhaust gas on a surface of the heat exchanger. Thus, the drain may evaporate into vapor again depending on a temperature around the heat exchanger or an amount of the drain.

In a so-called upward combustion type combustion apparatus configured such that the burner is disposed below the heat exchanger and the combustion exhaust gas generated by the burner is supplied to the heat exchanger from a bottom to a top, after the post-purge operation ends, the vapor generated around the heat exchanger ascends inside the housing, and continues to flow to an exhaust port on an upper side. Therefore, the vapor imparts no negative affect on other components. However, in a so-called downward combustion type combustion apparatus configured such that the burner is disposed above the heat exchanger and the combustion exhaust gas generated by the burner is supplied to the heat exchanger from above, after the post-purge operation ends, the vapor flows back upward inside the housing. As a result, components such as the combustion fan and a pre-mixing device provided upstream of the burner may be corroded.

In light of the above-described problem, it can also be considered to prolong the post-purge operation until evaporation of the drain ends. However, if the post-purge operation is continued for a long time, water inside the heat exchanger is excessively cooled. As a result, there is a possibility that a time lag from resume of the combustion operation to supply of hot water at a desired temperature to a hot water supplying terminal becomes longer, or that under a cold environment, the water freezes inside the heat exchanger, which leads to a defect of hot water supply. Further, there is a problem that power consumption and noise increase, insomuch as the combustion fan continues to activate for a long time.

PRIOR ARTS

[Patent Document 1] Japanese Unexamined Patent Publication No. 2013-242096 A

[Patent Document 2] Japanese Unexamined Patent Publication No. 2008-2701 A

[Patent Document 3] Japanese Unexamined Patent Publication No. H11-101449 A

SUMMARY OF THE INVENTION

The present invention has been made to solve the problems described above, and an object of the present invention is to enhance hot water resupply performance and to reduce power consumption and noise during operation in a combustion apparatus such as a water heater and a heat source device for a room heater.

According to one aspect of the present invention, there is provided a combustion apparatus comprising:

a housing accommodating a burner configured to burn combustion gas and a heat exchanger configured to recover heat in combustion exhaust gas generated by the burner to heat water supplied from a water supply source;

a combustion fan configured to supply air for combustion of the burner into the housing, the heat exchanger being disposed below the burner inside the housing, and the combustion exhaust gas from the burner being supplied to the heat exchanger from above;

a post-purge operation-executing section configured to activate the combustion fan for a predetermined period of time after combustion operation of the burner stops; and an intermittent blower operation-executing section configured to repeat activation and deactivation of the combustion fan a plurality of times at predetermined intervals after the post-purge operation ends.

According to the present invention, since water inside the heat exchanger is not excessively cooled during a period until combustion operation is resumed next, it not only can make shorter a time lag till hot water at a predetermined temperature is supplied to the hot water supplying terminal, but can prevent freezing of the water inside the heat exchanger. Thus, hot water resupply performance is enhanced. Moreover, since the activation time of the combustion fan is shortened, power consumption and noise during operation are reduced.

Other objects, features and advantages of the present invention will become more fully understood from the detailed description given hereinbelow and the accompanying drawings.

DESCRIPTION OF EMBODIMENTS

Hereinafter, referring to drawings, a combustion apparatus according to an embodiment of the present invention will be described in detail.

Figure 1:
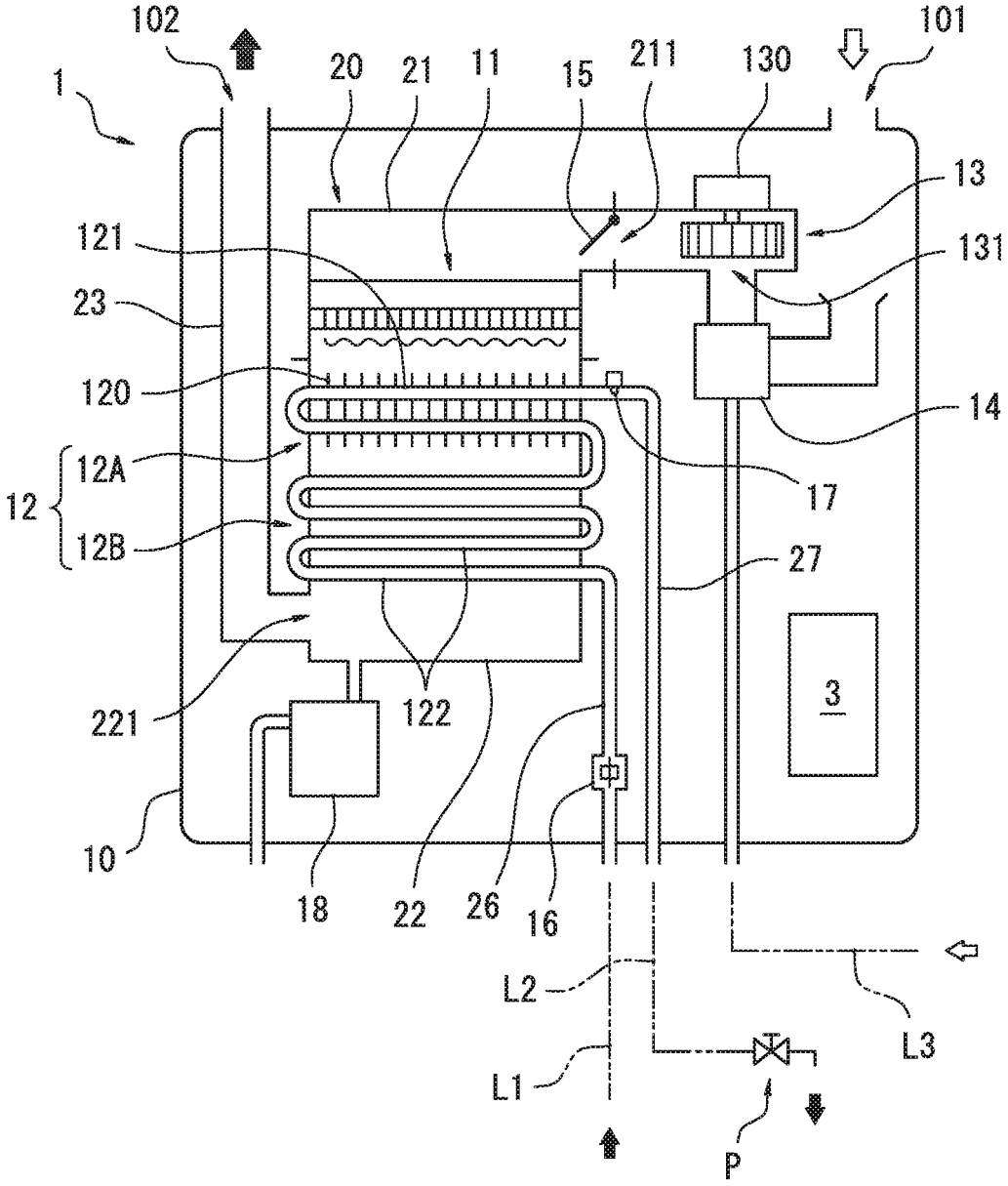
FIG. 1 is a schematic diagram of a combustion apparatus in an embodiment of the present invention.

As shown in FIG. 1, the combustion apparatus according to the embodiment of the present invention is a water heater 1 that heats water supplied into a heat exchanger 12 from a water supply pipe L1 with combustion exhaust gas generated by a burner 11, and supplies it to a hot-water supplying terminal P such as a faucet or a shower through a hot-water supply pipe L2.

Inside an exterior case 10 of the water heater 1, a substantially rectangular box shaped housing 20 accommodating the burner 11 and the heat exchanger 12 is provided. The exterior case 10 is provided with an air inlet port 101 to take air outside the apparatus into the exterior case 10 and an exhaust port 102 to discharge the air and the combustion exhaust gas inside the housing 20 to an outside of the apparatus.

The housing 20 is configured by a lower-side opening box shaped combustion chamber 21 forming an upper portion of the housing 20, and an upper-side opening box shaped heat exchange chamber 22 forming a lower portion of the housing 20. To an air leading-out port 221 provided in a lower area of the heat exchange chamber 22 is connected the exhaust port 102 through an exhaust passage 23.

In the combustion chamber 21, the burner 11 configured to burn combustion gas supplied from a gas pipe L3 to generate the combustion exhaust gas is incorporated. On the other hand, in the heat exchange chamber 22, the heat exchanger 12 configured to recover heat in the combustion exhaust gas generated by the burner 11 to heat the water supplied from the water supply pipe L1 is incorporated.

An air introduction port 211 provided in an upper portion of the combustion chamber 21 is continuously connected to a combustion fan 13 for taking, as the air for combustion of the burner 11, the air outside the apparatus into the exterior case 10 from the air inlet port 101 and sending it into the combustion chamber 21. Moreover, a suction port 131 of the combustion fan 13 is continuously connected to a pre-mixing device 14 for mixing the air taken into the exterior case 10 from the air inlet port 101 and the combustion gas supplied from the gas pipe L3. Furthermore, the air introduction port 211 of the combustion chamber 21 is provided with a check valve 15 configured to prevent the air and the combustion exhaust gas inside the housing 20 from flowing back to a combustion fan 13 side, that is, on an upstream side.

Inside the exterior case 10 of the above-described water heater 1, a supply-exhaust path from the air inlet port 101 to the exhaust port 102 through the housing 20 is defined. The premixing device 14, the combustion fan 13, the check valve 15, the burner 11, and the heat exchanger 12 are arranged in this order from an upstream side of the supply-exhaust path. Accordingly, when the combustion fan 13 is activated, the air outside the apparatus is taken into an internal space of the exterior case 10 from the air inlet port 101. The taken air is then introduced into the combustion chamber 21 through the pre-mixing device 14, and further, sequentially passes through setting parts of the burner 11 and the heat exchanger 12 to be discharged outside from the exhaust port 102.

The burner 11 has a plurality of flame ports (not shown) in a lower surface, and ejects a mixture gas of the combustion gas and the air mixed in the pre-mixing device 14 downward from the flame ports to burn the same. That is, the burner 11 is configured such a manner that the lower surface becomes a combustion surface.

The heat exchanger 12 is configured by the plurality of plate shaped heat transfer fins 120 provided vertically, and arranged side horizontally by side in an upper space of the heat exchange chamber 22, first heat transfer tubes 121 inserted into the respective heat transfer fins 120, and arranged in a plurality of rows vertically and in parallel substantially horizontally in the upper space of the heat exchange chamber 22, and second heat transfer tubes 122 arranged in a plurality of rows vertically and in parallel substantially horizontally in a lower space of the heat exchange chamber 22. In this heat exchanger 12, after sensible heat in the combustion gas introduced from the combustion chamber 21 into the heat exchange chamber 22 is recovered by the first heat transfer tubes 121, sensible heat and latent heat in the combustion gas are further recovered by the second heat transfer tubes 122.

Tube ends of the first heat transfer tubes 121 are connected to each other by coupling headers not shown to configure one sensible heat exchanging pipe line 12A meandering in the upper space of the heat exchange chamber 22. Tube ends of the second heat transfer tubes 122 are similarly connected to each other by coupling headers not shown to configure one latent heat exchanging pipe line 12B meandering in the lower space of the heat exchange chamber 22.

An inlet-side tube end of the latent heat exchanging pipe line 12B connects to the water supply pipe L1 through a water inlet pipe line 26, and an outlet-side tube end of the latent heat exchanging pipe line 12B connects to an inlet-side tube end of the sensible heat exchanging pipe line 12A. Moreover, an outlet-side tube end of the sensible heat exchanging pipe line 12A connects to the hot-water supply pipe L2 through a hot water outlet pipe line 27. Accordingly, the water supplied from the water supply pipe L1 into the water inlet pipe line 26 sequentially flows through the latent heat exchanging pipe line 12B and the sensible heat exchanging pipe line 12A, and then, is led out from the hot water outlet pipe line 27 to the hot-water supply pipe L2.

The water inlet pipe line 26 is provided with a flow sensor 16 for detecting a water supply amount to the heat exchanger 12. On the other hand, the hot water outlet pipe line 27 is provided with a heat exchanger temperature sensor 17 for detecting a hot water temperature from the sensible heat exchanging pipe line 12A.

When the heat exchanger 12 recovers the sensible heat and the latent heat in the combustion exhaust gas, strong acid drain, which is generated by condensing moisture in the combustion exhaust gas on surfaces of the heat transfer fins 120, the first heat transfer tubes 121, and the second heat transfer tubes 122, drops on a bottom portion of the heat exchange chamber 22. The dropping drain is collected and neutralized in a drain neutralizer 18 coupled to the bottom portion of the heat exchange chamber 22.

In the exterior case 10, a control circuit 3 configured to control operation of the whole water heater 1 is incorporated. The control circuit 3 is connected to an ignition electrode (not shown) of the burner 11, a fan motor 130 of the combustion fan 13, a mixing valve (not shown) of the pre-mixing device 14, the flow sensor 16, and the heat exchanger temperature sensor 17 via electric lines.

Although not shown, the control circuit 3 has circuit configurations of a combustion control section configured to perform ignition, extinction, and adjustment of a combustion amount of the burner 11, a supply-exhaust control section configured to perform activation, deactivation, and adjustment of a rotational speed of the combustion fan 13, a water supply-determining section configured to determine whether or not the water supply to the hot water supplying terminal P is performed on the basis of a water amount detected by the flow sensor 16, a heat exchanger temperature-determining section configured to determine a temperature of the heat exchanger 12 (hereinafter, refer to as a "heat exchanger temperature") T1 on the basis of a temperature detected by the heat exchanger temperature sensor 17, a clock section configured to measure an activation time and a deactivation time of the combustion fan 13, and a memory configured to store a set activation time, a set deactivation time, and a number of activation of the combustion fan 13 during intermittent blower operation, and so on.

Furthermore, the control circuit 3 of the water heater 1 according to the first embodiment has circuit configurations of a combustion operation-executing section configured to execute the combustion operation in which when the water supply to the hot water supplying terminal P is started, the combustion fan 13 is activated to supply the mixture gas to the burner 11 and the burner 11 is ignited, and when the water supply to the hot water supplying terminal P is stopped, the supply of the combustion gas to the burner 11 is cut off and the burner 11 is extinguished, a post-purge operation-executing section configured to further activate the combustion fan 13 for a predetermined period of time after the combustion operation of the burner 11 is stopped, an intermittent blower operation-executing section configured to repeat the activation and the deactivation of the combustion fan 13 a plurality of times at predetermined intervals after the post-purge operation ends, a blowing stop operation-executing section configured to stop the intermittent blower operation at a time point when the heat exchanger temperature T1 becomes lower than a reference temperature Ts during the intermittent blower operation, a first blowing interval-setting section configured to set the deactivation time of the combustion fan 13 during the intermittent blower operation in accordance with the number of activation of the combustion fan 13, and a first blowing amount-setting section configured to set the activation time and the rotational speed of the combustion fan 13 during the intermittent blower operation in accordance with the number of activation of the combustion fan 13, and so on.

Figure 2:
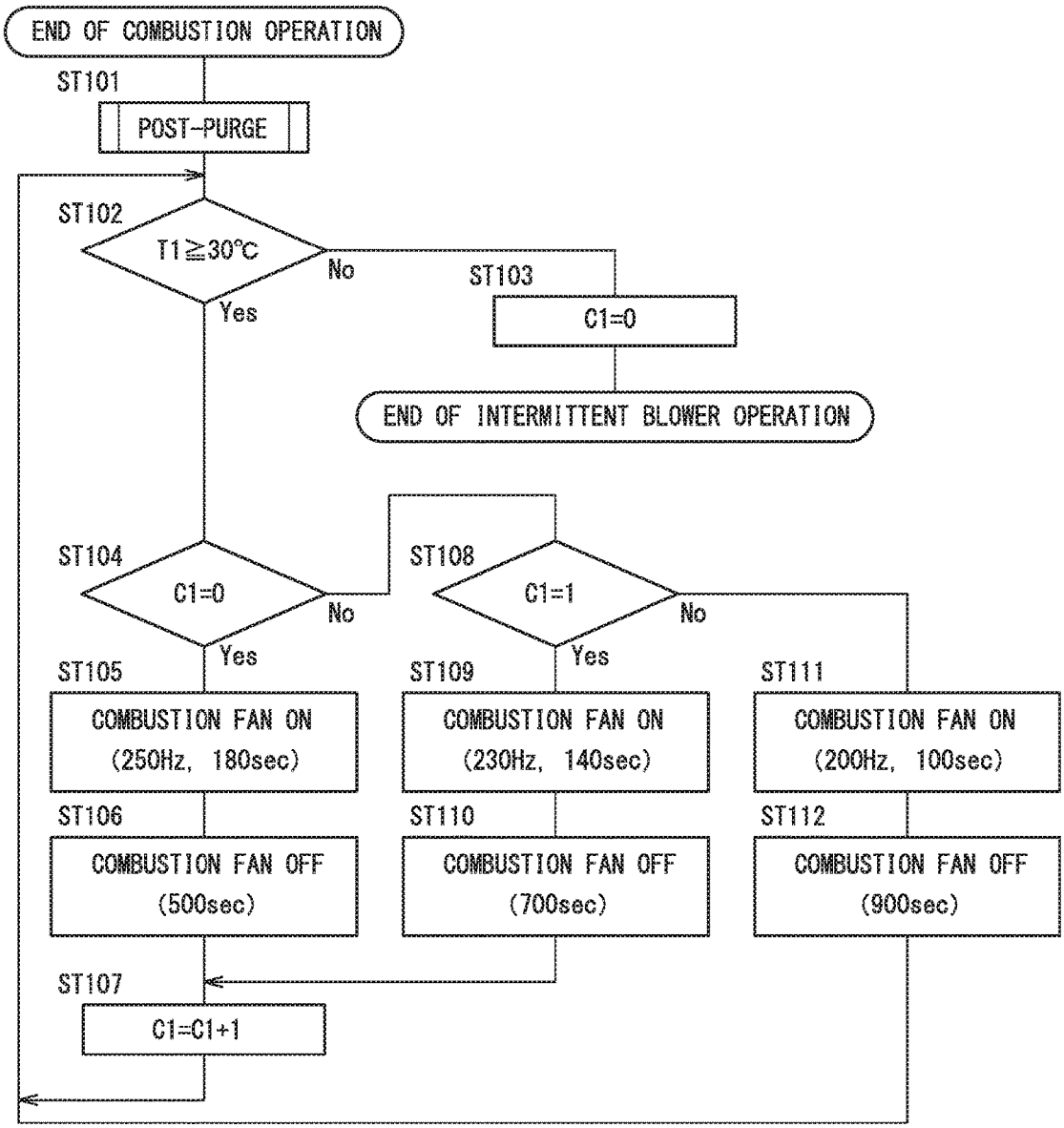
FIG. 2 is a control flowchart after combustion operation of the combustion apparatus stops in a first embodiment of the present invention.

FIG. 2 is a flowchart showing control operation after the combustion operation of the water heater 1 according to the first embodiment of the present invention stops. In the water heater 1, although not shown, when the water amount detected by the flow sensor 16 becomes a predetermined value or higher, the control circuit 3 determines whether the water supply to the hot water supplying terminal P is started, activates the combustion fan 13 to supply the mixture gas to the burner 11, and ignites the burner 11. Moreover, when the water amount detected by the flow sensor 16 becomes lower than the predetermined value, the control circuit 3 determines whether the water supply to the hot water supplying terminal P is stopped, cuts off the supply of the mixture gas to the burner 11, and extinguishes the burner 11.

When the water supply to the hot water supplying terminal P is stopped during the combustion operation and the burner 11 is extinguished, the post-purge operation is performed in which the combustion fan 13 is further continuously activated at a predetermined purge rotational speed Mp (here, 200 Hz) for a predetermined period of time Ap (here, 180 seconds) from that point of time. This allows the air outside the apparatus to be taken into the housing 20, and allows the combustion exhaust gas remaining inside the housing 20 to be discharged to the outside of the apparatus (ST101).

If the post-purge operation makes the heat exchanger temperature T1 lower than the reference temperature Ts (here, 30 degrees Celsius), it is hard for the drain adhering to a surface of the heat exchanger 12 to become vapor. Therefore, the intermittent blower operation is not performed, and a number of activation C1 of the combustion fan 13 stored in the memory is reset to "0". Moreover, the water heater 1 returns to a standby state for waiting for resume of the water supply to the hot water supplying terminal P (ST102 to ST103).

On the other hand, if the heat exchanger temperature T1 is the reference temperature Ts or higher at a time point when the post-purge operation ends (Yes in the step of ST102), the drain adhering to the surface of the heat exchanger 12 easily becomes the vapor. Therefore, if a functional defect such as jamming of foreign objects, a failure, and the like occurs in the check valve 15, there is a possibility that the vapor flows back from the heat exchange chamber 22 to the upstream side of the combustion chamber 21. Accordingly, the intermittent blower operation is performed in which the activation and the deactivation of the combustion fan 13 are repeated a plurality of times at the predetermined intervals. Specifically, if in the intermittent blower operation, the number of activation C1 of the combustion fan 13 is "0", the control circuit 3 activates the combustion fan 13 for a first set activation time A1 (here, 180 seconds) and at a first set rotational speed M1 (here, 250 Hz), and subsequently, deactivates the combustion fan 13 for a first set deactivation time B1 (here, 500 seconds). Moreover, the control circuit 3 adds "1" to the stored number of activation C1 of the combustion fan 13, and causes the memory to store the new C1 (ST104 to ST107).

Again, the determination as to whether or not the heat exchanger temperature T1 is the reference temperature Ts or higher is performed. As a result, if the heat exchanger temperature T1 is the reference temperature Ts or higher (Yes in the step of ST102), and the number of activation C1 is "1" (No in the step of ST104), the control circuit 3 activates the combustion fan 13 for a second set activation time A2 (here, 140 seconds) shorter than the first set activation time A1 and at a second set rotational speed M2 (here, 230 Hz) lower than the first set rotational speed M1, and subsequently, deactivates the combustion fan 13 for a second set deactivation time B2 (here, 700 seconds) longer than the first set deactivation time B1. Moreover, the control circuit 3 adds "1" to the stored number of activation C1 of the combustion fan 13, and causes the memory to store the new C1. That is, the control circuit 3 sets the activation time of the combustion fan 13 to be shorter, the rotational speed to be lower, and the deactivation time to be longer by one level than the step of reference on/off operation in ST105 to ST106 to cause the combustion fan 13 to perform on/off operation (ST108 to ST110, ST107).

Subsequently, again, the determination as to whether or not the heat exchanger temperature T1 is the reference temperature Ts or higher is performed. As a result, if the heat exchanger temperature T1 is the reference temperature Ts or higher (Yes in the step of ST102), and the number of activation C1 is neither "0" nor "1" (No in both steps of ST104 and ST108), the control circuit 3 activates the combustion fan 13 for a third set activation time A3 (here, 100 seconds) shorter than the second set activation time A2 and at a third set rotational speed M3 (here, 200 Hz) lower than the second set rotational speed M2, and subsequently, deactivates the combustion fan 13 for a third set deactivation time B3 (here, 900 seconds) longer than the second set deactivation time B2. It is then determined whether or not the heat exchanger temperature T1 is the reference temperature Ts or higher. That is, the control circuit 3 sets the activation time of the combustion fan 13 to be shorter, the rotational speed to be lower, and the deactivation time to be longer by one level than the step of on/off operation in ST109 to ST110 to cause the combustion fan 13 to perform on/off operation (ST111 to ST112).

If the heat exchanger temperature T1 is lower than the reference temperature Ts (No in the step of ST102) during the intermittent blower operation is performed as described above, it is determined whether evaporation of the drain ends, the number of activation C1 of the combustion fan 13 stored in the memory is reset to "0", and the intermittent blower operation ends (ST103).

Figure 3:
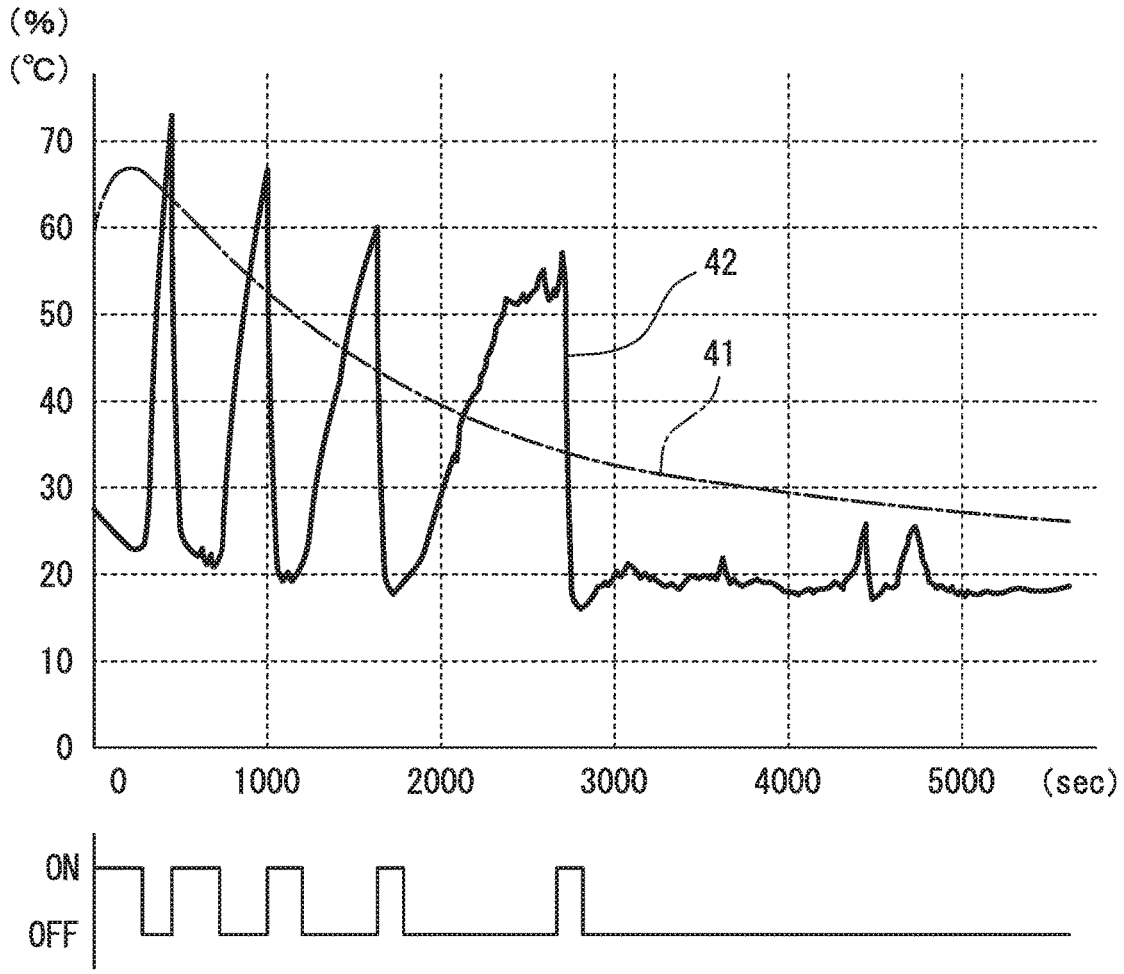
FIG. 3 is a graph showing a relationship between on/off operation of a combustion fan and humidity inside a housing during intermittent blow operation of the combustion apparatus in the first embodiment of the present invention.

In FIG. 3, a dashed line 41 indicates temperature change of the heat exchanger temperature T1 in the intermittent blower operation, a thick solid line 42 indicates humidity change inside the housing 20 in the intermittent blower operation, and a thin solid line in a lower portion indicates the on/off operation of the combustion fan 13. Therefore, FIG. 3 shows a relationship between the on/off operation of the combustion fan 13 and the heat exchanger temperature T1 and a relationship between the on/off operation of the combustion fan 13 and the humidity inside the housing 20. Although units of the dashed line 41 and the thick solid line 42 are different because they indicate the temperature and the humidity, respectively, numerical value ranges are common, and thus, a single vertical axis is used. As shown in FIG. 3, the temperature (the heat exchanger temperature) T1 of the heat exchanger 12 gradually decreases during the intermittent blower operation. On the other hand, the humidity inside the housing 20 gradually decreases while repeating rising and falling in accordance with the activation and the deactivation of the combustion fan 13. Moreover, when the heat exchanger temperature T1 decreases up to a temperature close to the reference temperature Ts (30 degrees Celsius), the humidity hardly rises even in a case where the combustion fan 13 is deactivated.

In this manner, according to the water heater 1 of the first embodiment, since the vapor generated around the heat exchanger 12 after the end of the post-purge operation is discharged to the outside through the intermittent blower operation, the water inside the heat exchanger 12 is not excessively cooled. This not only can make shorter a time lag till hot water at a predetermined temperature is supplied to the hot water supplying terminal P, but can prevent freezing of the water inside the heat exchanger 12. Thus, hot water resupply performance is enhanced. Moreover, since the activation time of the combustion fan 13 required for backflow prevention of the vapor is shortened, power consumption and noise during the intermittent blower operation are reduced.

In addition, according to the water heater 1, when the heat exchanger temperature T1 becomes lower than the reference temperature Ts during execution of the intermittent blower operation, the intermittent blower operation is stopped to stop the blowing into the housing 20 thereafter. Accordingly, it is harder to cool the water inside the heat exchanger 12. This not only can make further shorter the time lag, but can prevent freezing of the water inside the heat exchanger 12 securely. Thus, the hot water resupply performance is further enhanced. Moreover, since the activation time of the combustion fan 13 required for the backflow prevention of the vapor is further shortened, the power consumption and the noise during the intermittent blower operation are significantly reduced.

Moreover, after the end of the post-purge operation, an amount and an ascending speed of the vapor generated around the heat exchanger 12 are decreased, as the temperature of the heat exchanger 12 becomes lower. On the other hand, in the water heater 1, during the intermittent blower operation, the deactivation time of the combustion fan 13 is set to gradually become longer than that at an initial deactivation in accordance with the number of activation of the combustion fan 13. That is, since every time the activation and the deactivation of the combustion fan 13 are repeated, the deactivation time becomes longer, it is harder to cool the water inside the heat exchanger 12. This not only can make further shorter the time lag, but can prevent freezing of the water inside the heat exchanger 12 securely. Thus, the hot water resupply performance is further enhanced. Moreover, since the activation time of the combustion fan 13 required for the backflow prevention of the vapor is further shortened, the power consumption and the noise during the intermittent blower operation are significantly reduced.

Furthermore, in the water heater 1, during the intermittent blower operation, the activation time of the combustion fan 13 is set to gradually become shorter than that at initial activation, and the rotational speed of the combustion fan 13 is set to gradually become lower than that at the initial activation, in accordance with the number of activation of the combustion fan 13. That is, since every time the activation and the deactivation of the combustion fan 13 are repeated, the activation time becomes shorter, and the rotational speed becomes lower, it is harder to cool the water inside the heat exchanger 12. This not only can make further shorter the time lag, but can prevent freezing of the water inside the heat exchanger 12 securely. Thus, the hot water resupply performance is further enhanced. Moreover, since the activation time of the combustion fan 13 during the intermittent blower operation is further shortened, the power consumption and the noise during the intermittent blower operation are significantly reduced.

A water heater 1 according to a second embodiment of the present invention further includes, in addition to the function of the first embodiment, a function of setting the deactivation time of the combustion fan 13 in the intermittent blower operation to be longer, the activation time therein to be shorter, and the rotational speed therein to be lower as the heat exchanger temperature T1 becomes lower. Particularly, the control circuit 3 further has, as circuit configurations, a second blowing interval-setting section configured to set the deactivation time of the combustion fan 13 during the intermittent blower operation in accordance with the heat exchanger temperature T1, and a second blowing amount-setting section configured to set the activation time and the rotational speed of the combustion fan 13 during the intermittent blower operation in accordance with the heat exchanger temperature T1. Meanwhile, since a basic configuration of the water heater 1 in the second embodiment to a fourth embodiment of the present invention is the same as that of the first embodiment, only a different configuration will be described.

Figure 4:
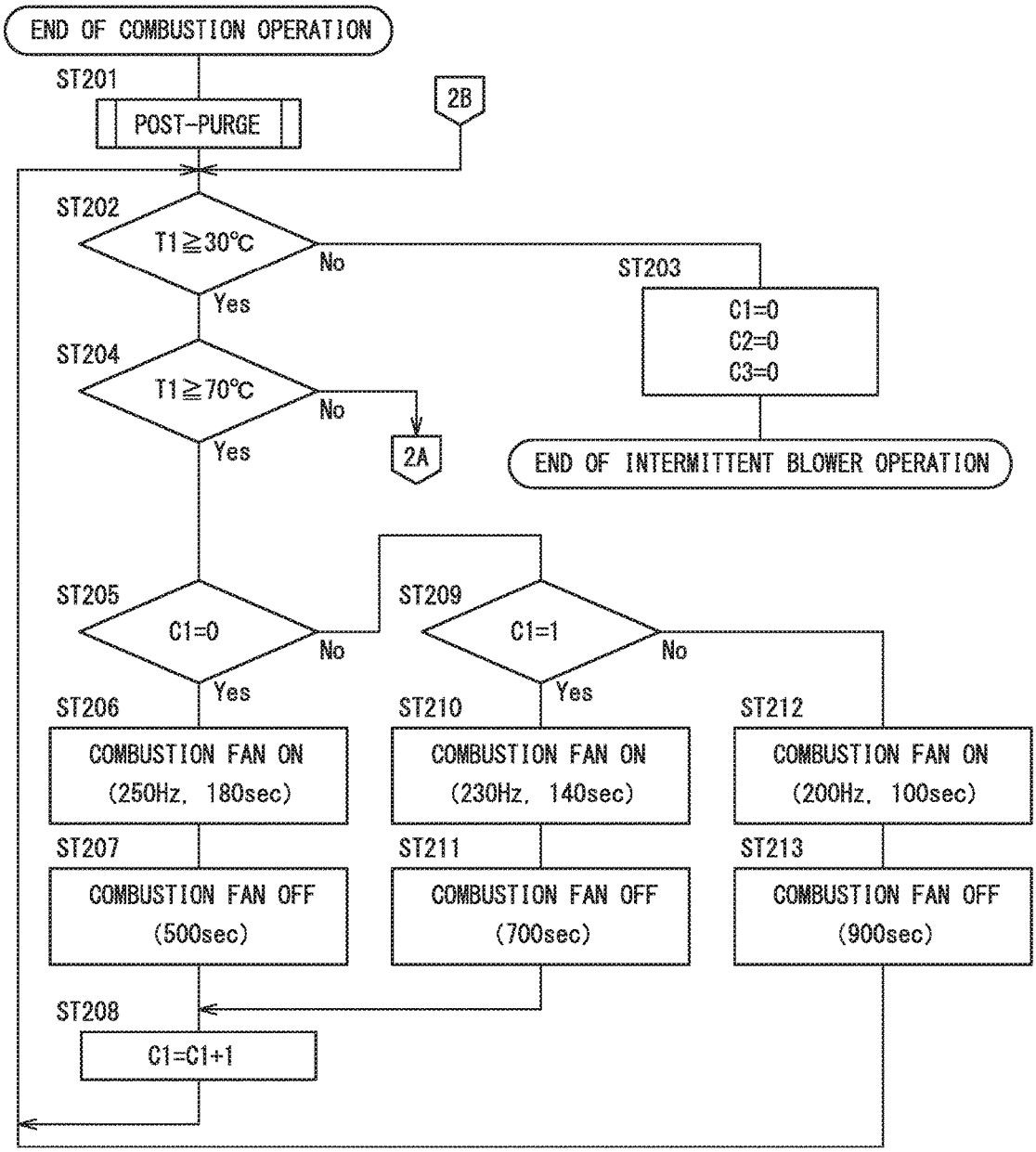
FIG. 4 is a partial operation flowchart after combustion operation of a combustion apparatus stops in a second embodiment of the present invention.
Figure 5:
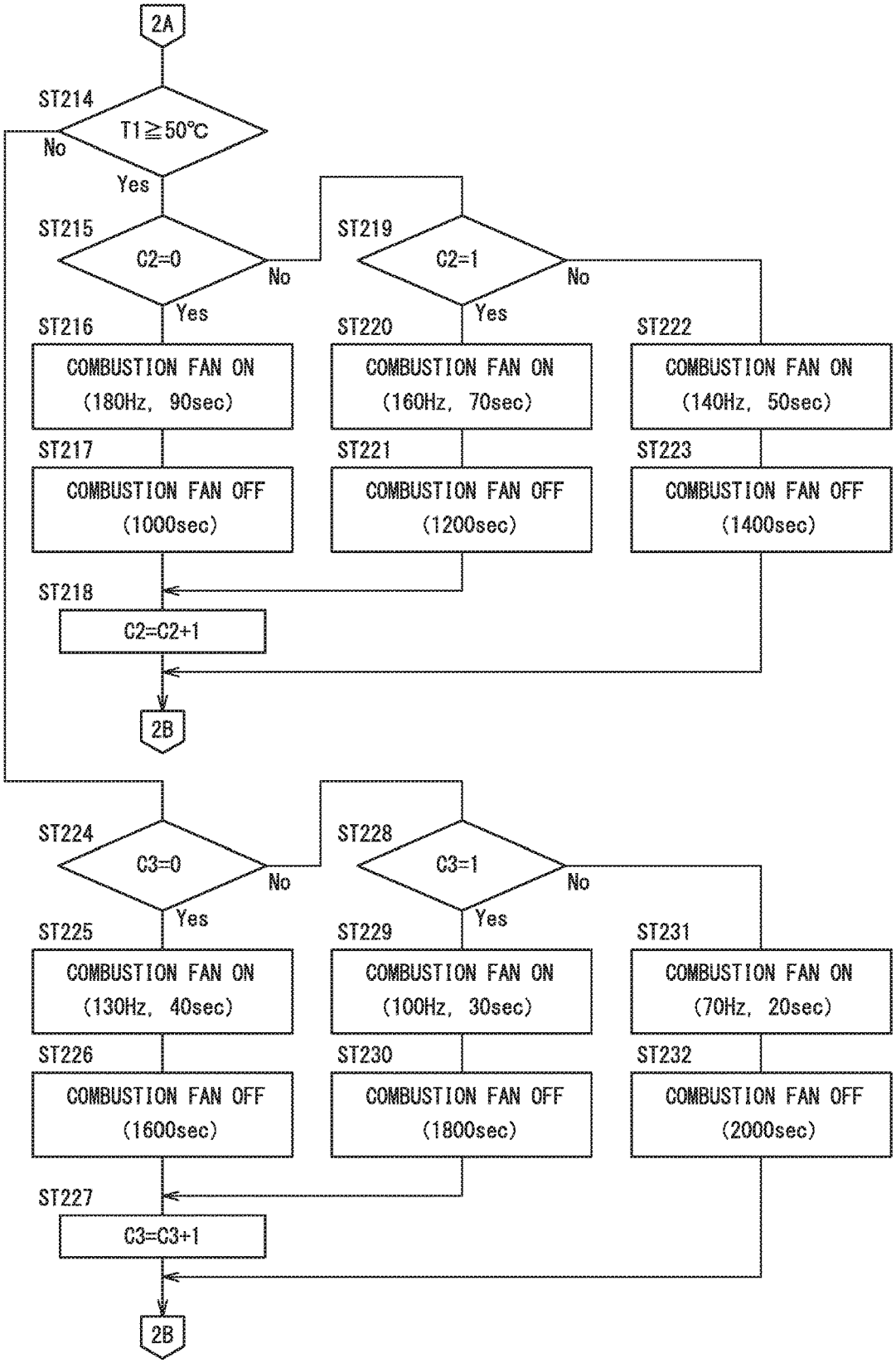
FIG. 5 is a partial operation flowchart after the combustion operation of the combustion apparatus stops in the second embodiment of the present invention.

FIGS. 4 and 5 are flowcharts showing control operation after the combustion operation of the water heater 1 according to the second embodiment of the present invention stops.

When the water supply to the hot water supplying terminal P is stopped during the combustion operation and the burner 11 is extinguished, the post-purge operation is performed as in the first embodiment. As a result, if the heat exchanger temperature T1 becomes lower than the reference temperature Ts, the intermittent blower operation is not performed, and numbers of activation C1, C2, C3 of the combustion fan 13 in respective predetermined temperature conditions, which are stored in the memory, are reset to "0". Moreover, the water heater 1 returns to the standby state for waiting for the resume of the water supply to the hot water supplying terminal P (ST201 to ST203).

On the other hand, at the time point when the post-purge operation ends, if the heat exchanger temperature T1 is the reference temperature Ts or higher (Yes in the step of ST202), the drain adhering to the surface of the heat exchanger 12 easily becomes the vapor. Therefore, the intermittent blower operation is performed in which the activation and the deactivation of the combustion fan 13 are repeated a plurality of times at the predetermined intervals. Specifically, if the heat exchanger temperature T1 is the reference temperature Ts or higher, it is further determined whether or not the heat exchanger temperature T1 is a first determination temperature Ta (here, 70 degrees Celsius) or higher (ST204).

If the heat exchanger temperature T1 is the first determination temperature Ta or higher (Yes in the step of ST204), the amount of the vapor generated from the heat exchanger 12 is relatively large. Therefore, as in the steps from ST104 to ST112 in the first embodiment, the intermittent blower operation is performed while making the activation time of the combustion fan 13 shorter, the rotational speed lower, and the deactivation time longer in accordance with the increase in the number of activation (a first number of activation) C1 of the combustion fan 13 in a first temperature condition (ST205 to ST213).

If the heat exchanger temperature T1 becomes lower than the first determination temperature Ta during the intermittent blower operation, or at the time point when the post-purge operation ends (No in the step of ST204), it is further determined whether or not the heat exchanger temperature T1 is a second determination temperature Tb (here, 50 degrees Celsius) or higher (ST214).

If the heat exchanger temperature T1 is the second determination temperature Tb or higher (Yes in the step of ST214), and the number of activation (a second number of activation) C2 of the combustion fan 13 in a second temperature condition is "0" (Yes in the step of ST215), the control circuit 3 activates the combustion fan 13 for a fourth set activation time A4 (here, 90 seconds) shorter than the third set activation time A3 and at a fourth set rotational speed M4 (here, 180 Hz) lower than the third set rotational speed M3, and subsequently, deactivates the combustion fan 13 for a fourth set deactivation time B4 (here, 1000 seconds) longer than the third set deactivation time B3. Moreover, the control circuit 3 adds "1" to the stored second number of activation C2, and causes the memory to store the new C2. That is, the control circuit 3 sets the activation time of the combustion fan 13 to be shorter, the rotational speed to be lower, and the deactivation time to be longer by one level than the step of on/off operation in ST212 to ST213 in the first temperature condition to cause the combustion fan 13 to perform on/off operation (ST215 to ST218).

Again, the determination as to whether or not the heat exchanger temperature T1 is the reference temperature Ts or higher is performed. As a result, if the heat exchanger temperature T1 is the reference temperature Ts or higher (Yes in the step of ST202), but is lower than the first determination temperature Ta, and the second determination temperature Tb or higher (No in the step of ST204 and Yes in the step of ST214), and if the second number of activation C2 is "1" (No in the step of ST215 and Yes in the step of ST219), the control circuit 3 activates the combustion fan 13 for a fifth set activation time A5 (here, 70 seconds) shorter than the fourth set activation time A4 and at a fifth set rotational speed M5 (here, 160 Hz) lower than the fourth set rotational speed M4, and subsequently, deactivates the combustion fan 13 for a fifth set deactivation time B5 (here, 1200 seconds) longer than the fourth set deactivation time B4. Moreover, the control circuit 3 adds "1" to the stored second number of activation C2 to cause the memory to store the new C2 (ST219 to ST221, ST218).

Subsequently, again, the determination as to whether or not the heat exchanger temperature T1 is the reference temperature Ts or higher is performed. As a result, if the heat exchanger temperature T1 is the reference temperature Ts or higher (Yes in the step of ST202), but is lower than the first determination temperature Ta, and the second determination temperature Tb or higher (No in the step of ST204 and Yes in the step of ST214), and if the second number of activation C2 is neither "0" nor "1" (No in both steps of ST215 and ST219), the control circuit 3 activates the combustion fan 13 for a sixth set activation time A6 (here, 50 seconds) shorter than the fifth set activation time A5 and at a sixth set rotational speed M6 (here, 140 Hz) lower than the fifth set rotational speed M5, and subsequently, deactivates the combustion fan 13 for a sixth set deactivation time B6 (here, 1400 seconds) longer than the fifth set deactivation time B5 (ST222 to ST223). The determination as to whether or not the heat exchanger temperature T1 is the reference temperature Ts or higher is then performed.

If the heat exchanger temperature T1 becomes lower than the second determination temperature Tb during the intermittent blower operation, or at the time point when the post-purge operation ends (No in the step of ST214), and the number of activation (a third number of activation) C3 of the combustion fan 13 in a third temperature condition is "0" (Yes in the step of ST224), the control circuit 3 activates the combustion fan 13 for a seventh set activation time A7 (here, 40 seconds) shorter than the sixth set activation time A6 and at a seventh set rotational speed M7 (here, 130 Hz) lower than the sixth set rotational speed M6, and subsequently, deactivates the combustion fan 13 for a seventh set deactivation time B7 (here, 1600 seconds) longer than the sixth set deactivation time B6. Moreover, the control circuit 3 adds "1" to the stored third number of activation C3 to cause the memory to store the new C3. That is, the control circuit 3 sets the activation time of the combustion fan 13 to be shorter, the rotational speed to be lower, and the deactivation time to be longer by one level than the step of on/off operation in ST222 to ST223 in the second temperature condition to cause the combustion fan 13 to perform on/off operation (ST225 to ST227).

Subsequently, again, the determination as to whether or not the heat exchanger temperature T1 is the reference temperature Ts or higher is performed. As a result, if the heat exchanger temperature T1 is the reference temperature Ts or higher (Yes in the step of ST202), but is lower than the second determination temperature Tb (No in both steps of ST204 and ST214), and if the third number of activation C3 is "1" (No in the step of ST224 and Yes in the step of ST228), the control circuit 3 activates the combustion fan 13 for a eighth set activation time A8 (here, 30 seconds) shorter than the seventh set activation time A7 and at a eighth set rotational speed M8 (here, 100 Hz) lower than the seventh set rotational speed M7, and subsequently, deactivates the combustion fan 13 for a eighth set deactivation time B8 (here, 1800 seconds) longer than the seventh set deactivation time B7. Moreover, the control circuit 3 adds "1" to the stored third number of activation C3 to cause the memory to store the new C3 (ST228 to ST230, ST227).

Subsequently, again, the determination as to whether or not the heat exchanger temperature T1 is the reference temperature Ts or higher is performed. As a result, if the heat exchanger temperature T1 is the reference temperature Ts or higher (Yes in the step of ST202), but is lower than the second determination temperature Tb (No in both steps of ST204 and ST214), and if the third number of activation C3 is neither "0" nor "1" (No in both steps of ST224 and ST228), the control circuit 3 activates the combustion fan 13 for a ninth set activation time A9 (here, 20 seconds) shorter than the eighth set activation time A8 and at a ninth set rotational speed M9 (here, 70 Hz) lower than the eighth set rotational speed M8, and subsequently, deactivates the combustion fan 13 for a ninth set deactivation time B9 (here, 2000 seconds) longer than the eighth set deactivation time B8 (ST231 to ST232). The determination as to whether or not the heat exchanger temperature T1 is the reference temperature Ts or higher is then performed.

According to the second embodiment, since as the temperature of the heat exchanger 12 becomes lower, the deactivation time of the combustion fan 13 during the intermittent blower operation becomes the longer, the activation time becomes the shorter, and the rotational speed becomes the lower, the excessive cooling of the water inside the heat exchanger 12 can more surely be prevented. This not only can make further shorter the time lag, but can prevent freezing of the water inside the heat exchanger 12 securely. Thus, the hot water resupply performance is further enhanced. Moreover, since the activation time of the combustion fan 13 is further shortened, the power consumption and the noise during the intermittent blower operation are significantly reduced.

According to the second embodiment, as the temperature of the heat exchanger 12 becomes lower, the deactivation time of the combustion fan 13 during the intermittent blower operation is set to be longer, the activation time is set to be shorter, and the rotational speed is set to be lower. The water heater 1 according to the third embodiment further includes, in addition to the function of the first embodiment, a function of setting the deactivation time of the combustion fan 13 in the intermittent blower operation to be longer, the activation time therein to be shorter, and the rotational speed therein to be lower as a combustion time F1 of the burner 11 during the combustion operation becomes shorter. Particularly, the control circuit 3 further has, as circuit configurations, a clock section configured to measure the combustion time F1 of the burner 11 during the combustion operation, a third blowing interval-setting section configured to set the deactivation time of the combustion fan 13 during the intermittent blower operation in accordance with the combustion time F1 instead of the heat exchanger temperature T1, and a third blowing amount-setting section configured to set the activation time and the rotational speed of the combustion fan 13 during the intermittent blower operation in accordance with the combustion time F1 instead of the heat exchanger temperature T1.

Figure 6:
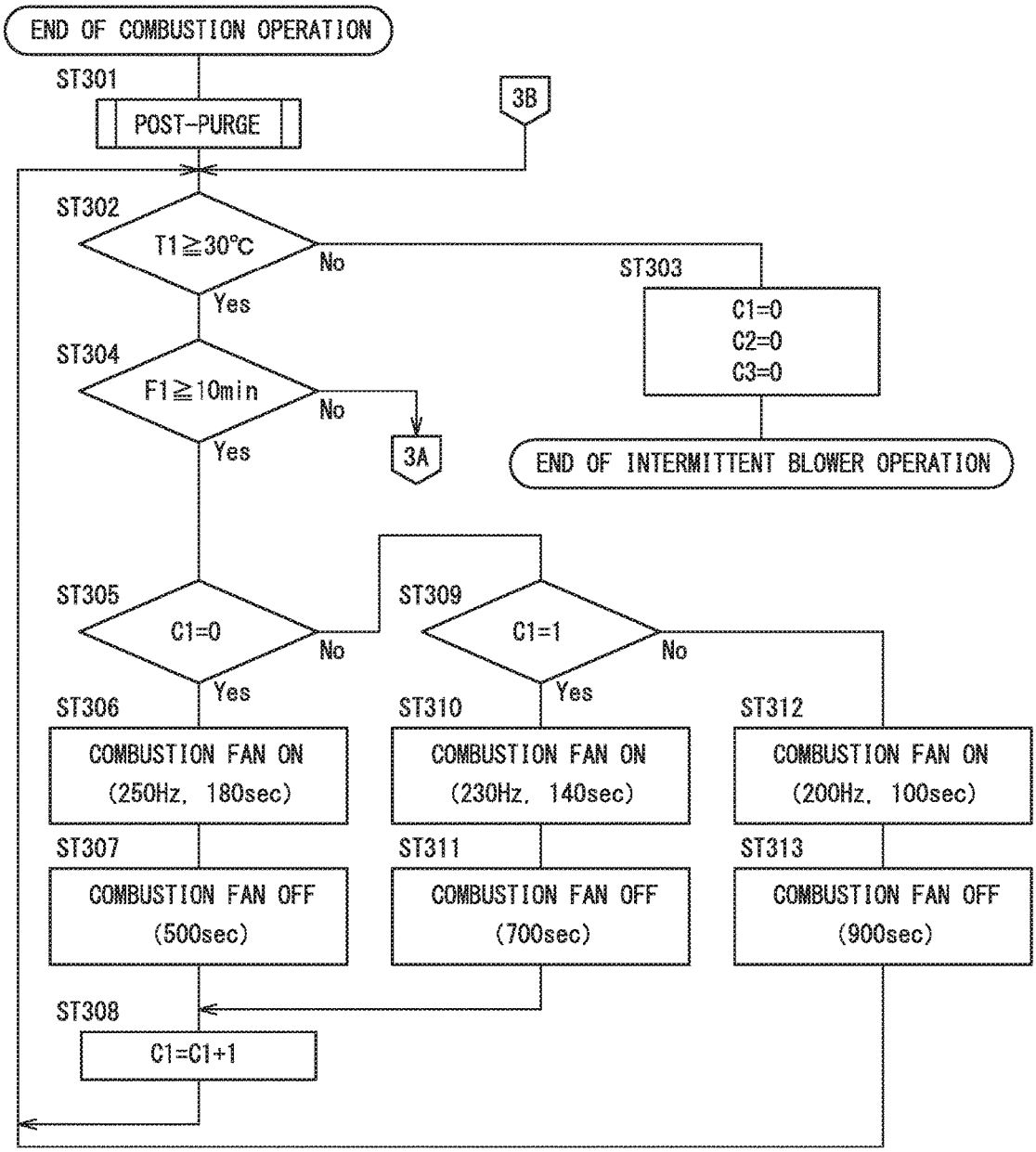
FIG. 6 is a partial operation flowchart after combustion operation of a combustion apparatus stops in a third embodiment of the present invention.
Figure 7:
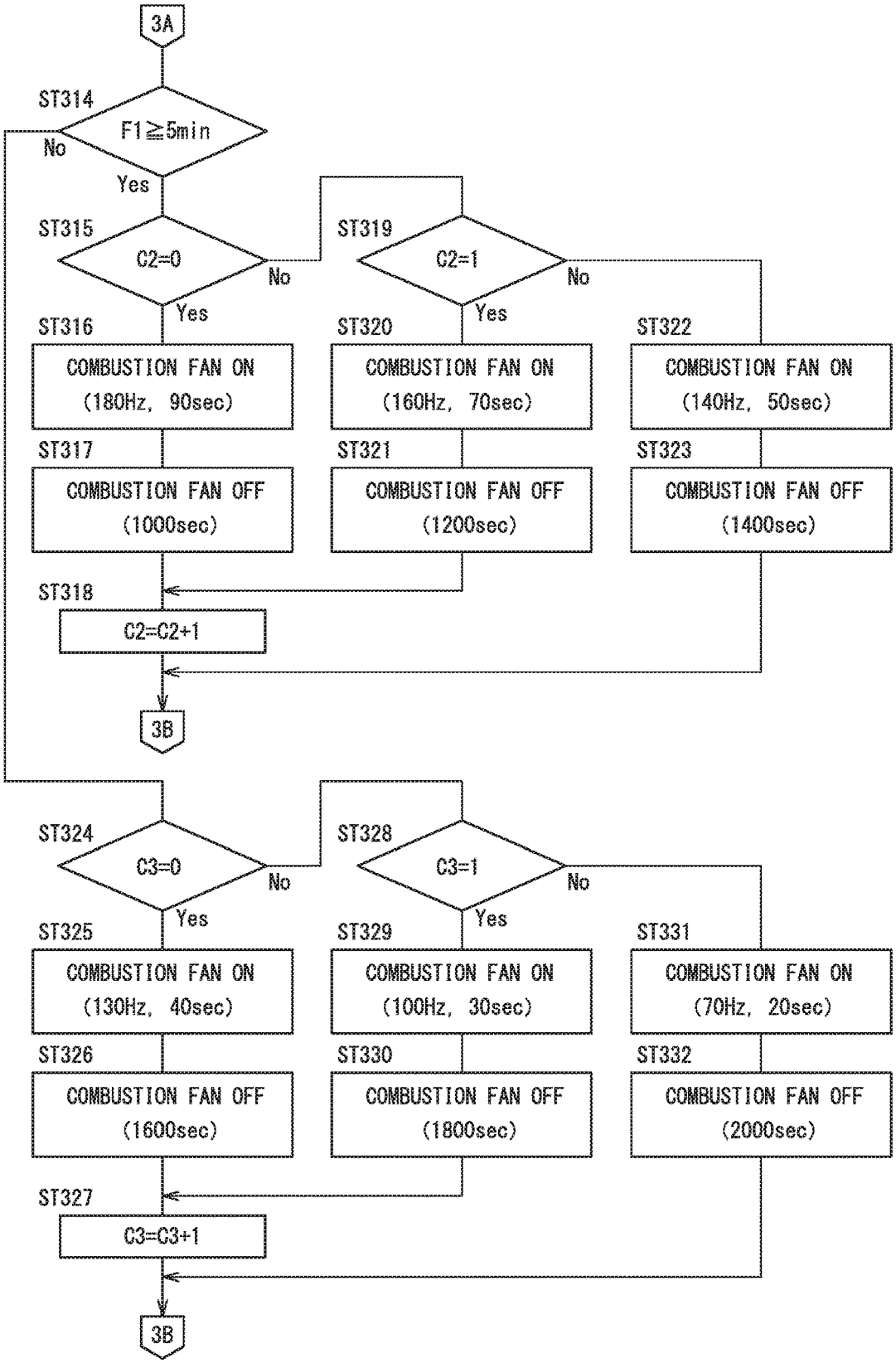
FIG. 7 is a partial operation flowchart after the combustion operation of the combustion apparatus stops in the third embodiment of the present invention.

FIGS. 6 and 7 are flowcharts showing control operation after the combustion operation of the water heater 1 according to the third embodiment of the present invention stops. In the water heater 1, although not shown, measurement of the combustion time F1 is performed from the time point when the water supply to the hot water supplying terminal P is started and the burner 11 is ignited to the time point when the water supply to the hot water supplying terminal P is stopped and the burner 11 is extinguished.

When the water supply to the hot water supplying terminal P is stopped during the combustion operation and the burner 11 is extinguished, the post-purge operation is performed as in the second embodiment. As a result, if the heat exchanger temperature T1 becomes lower than the reference temperature Ts, the intermittent blower operation is not performed, and numbers of activation C1, C2, C3 of the combustion fan 13 in respective predetermined combustion conditions, which are stored in the memory, are reset to "0". Moreover, the water heater 1 returns to the standby state for waiting for the resume of the water supply to the hot water supplying terminal P (ST301 to ST303).

On the other hand, at the time point when the post-purge operation ends, if the heat exchanger temperature T1 is the reference temperature Ts or higher (Yes in the step of ST302), the drain adhering to the surface of the heat exchanger 12 easily becomes the vapor. Therefore, the intermittent blower operation is performed in which the activation and the deactivation of the combustion fan 13 are repeated a plurality of times at the predetermined intervals. Specifically, if the heat exchanger temperature T1 is the reference temperature Ts or higher, it is further determined whether or not the combustion time F1 is a first determination time Fa (here, 10 minutes) or longer (ST304).

If the combustion time F1 is the first determination time Fa or longer (Yes in the step of ST304), the amount of the drain adhering to the surface of the heat exchanger 12 is relatively large and the amount of the vapor generated therefrom is relatively large. Therefore, as in the steps from ST205 to ST213 in the second embodiment, the intermittent blower operation is performed while making the activation time of the combustion fan 13 shorter, the rotational speed lower, and the deactivation time longer in accordance with the increase in the number of activation (a first number of activation) C1 of the combustion fan 13 in a first combustion condition (ST305 to ST313).

On the other hand, if the combustion time F1 is less than the first determination time Fa (No in the step ST304), but is a second determination time Fb (here, 5 minutes) or longer (Yes in the step ST314), which is less than the first determination time Fa, as in the steps from ST215 to ST223 in the second embodiment, the control circuit 3 sets the activation time of the combustion fan 13 to be shorter, the rotational speed to be lower, and the deactivation time to be longer by one level than the step of on/off operation in ST312 to ST313 to cause the combustion fan 13 to perform on/off operation. That is, the intermittent blower operation is performed while making the activation time of the combustion fan 13 shorter, the rotational speed lower, and the deactivation time longer in accordance with the increase in the number of activation (a second number of activation) C2 of the combustion fan 13 in a second combustion condition (ST315 to ST323).

Further, if the combustion time F1 is less than the second determination time Fb (No in the step ST314), as in the steps from ST224 to ST232 in the second embodiment, the control circuit 3 sets the activation time of the combustion fan 13 to be shorter, the rotational speed to be lower, and the deactivation time to be longer by one level than the step of on/off operation in ST322 to ST323 to cause the combustion fan 13 to perform on/off operation. That is, the intermittent blower operation is performed while making the activation time of the combustion fan 13 shorter, the rotational speed lower, and the deactivation time longer in accordance with the increase in the number of activation (a third number of activation) C3 of the combustion fan 13 in a third combustion condition (ST324 to ST332).

According to the third embodiment, as the combustion time F1 of the burner 11 during the combustion operation becomes shorter, the deactivation time of the combustion fan 13 during the intermittent blower operation becomes the longer, the activation time becomes the shorter, and the rotational speed becomes the lower. Thus, as the water heater 1 according to the second embodiment, the hot water resupply performance is further enhanced. Moreover, the power consumption and the noise during the intermittent blower operation are significantly reduced.

According to the third embodiment, as the combustion time F1 of the burner 11 during the combustion operation becomes shorter, the deactivation time of the combustion fan 13 during the intermittent blower operation is set to be longer, the activation time is set to be shorter, and the rotational speed is set to be lower. The water heater 1 according to a fourth embodiment further includes, in addition to the function of the first embodiment, a function of setting the deactivation time of the combustion fan 13 in the intermittent blower operation to be longer, the activation time therein to be shorter, and the rotational speed therein to be lower as an integrated combustion heat amount Q1 of the burner 11 for a predetermined period of time before end of the combustion operation becomes lower. Particularly, the control circuit 3 further has, as circuit configurations, a combustion heat amount-calculating section configured to calculate the integrated combustion heat amount Q1 for a time period from a predetermined time before the end of the combustion operation to the end of the combustion operation, a fourth blowing interval-setting section configured to set the deactivation time of the combustion fan 13 during the intermittent blower operation in accordance with the integrated combustion heat amount Q1 instead of the combustion time F1, and a fourth blowing amount-setting section configured to set the activation time and the rotational speed of the combustion fan 13 during the intermittent blower operation in accordance with the integrated combustion heat amount Q1 instead of the combustion time F1.

Figure 8:
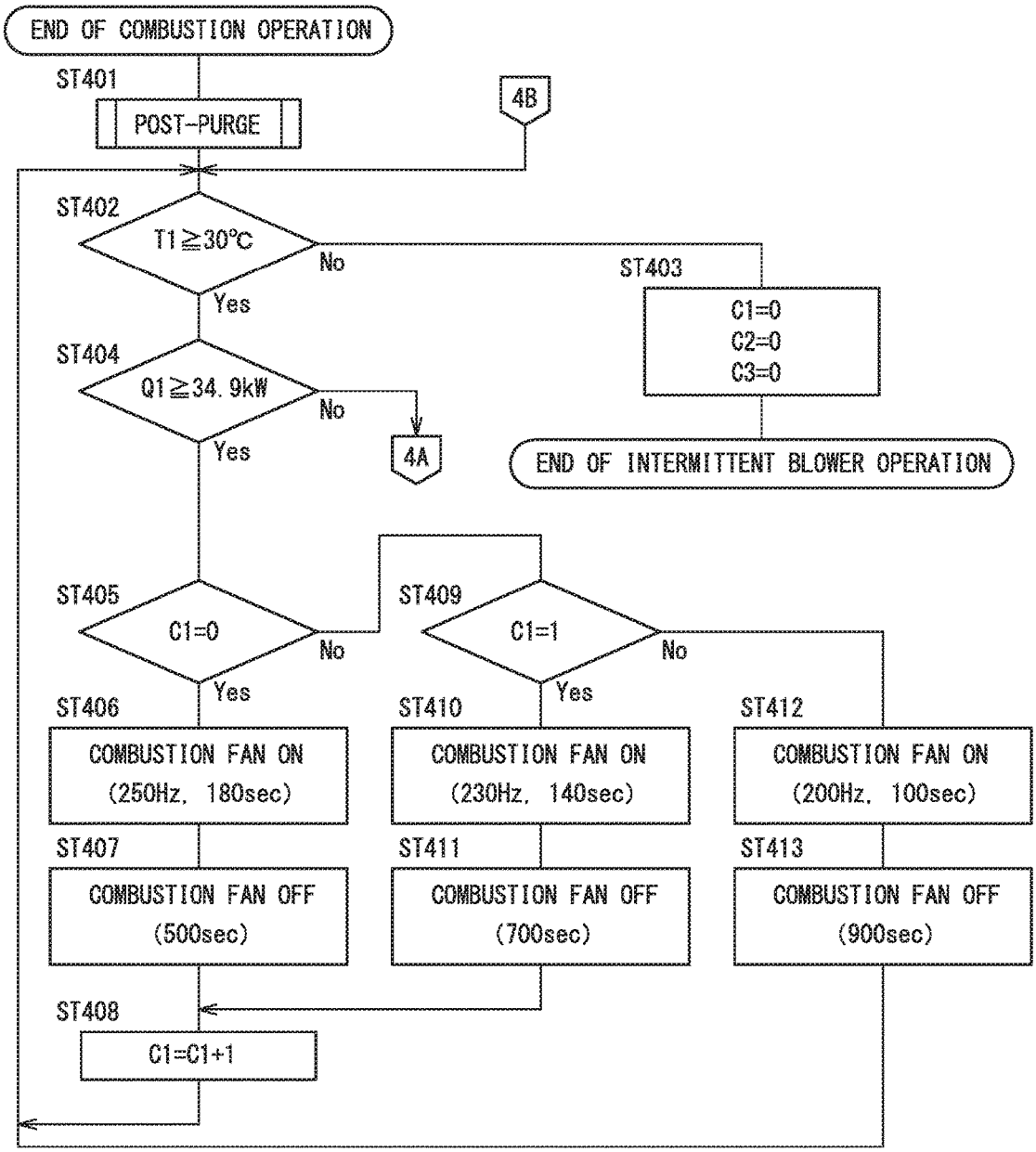
FIG. 8 is a partial operation flowchart after combustion operation of a combustion apparatus stops in a fourth embodiment of the present invention.
Figure 9:
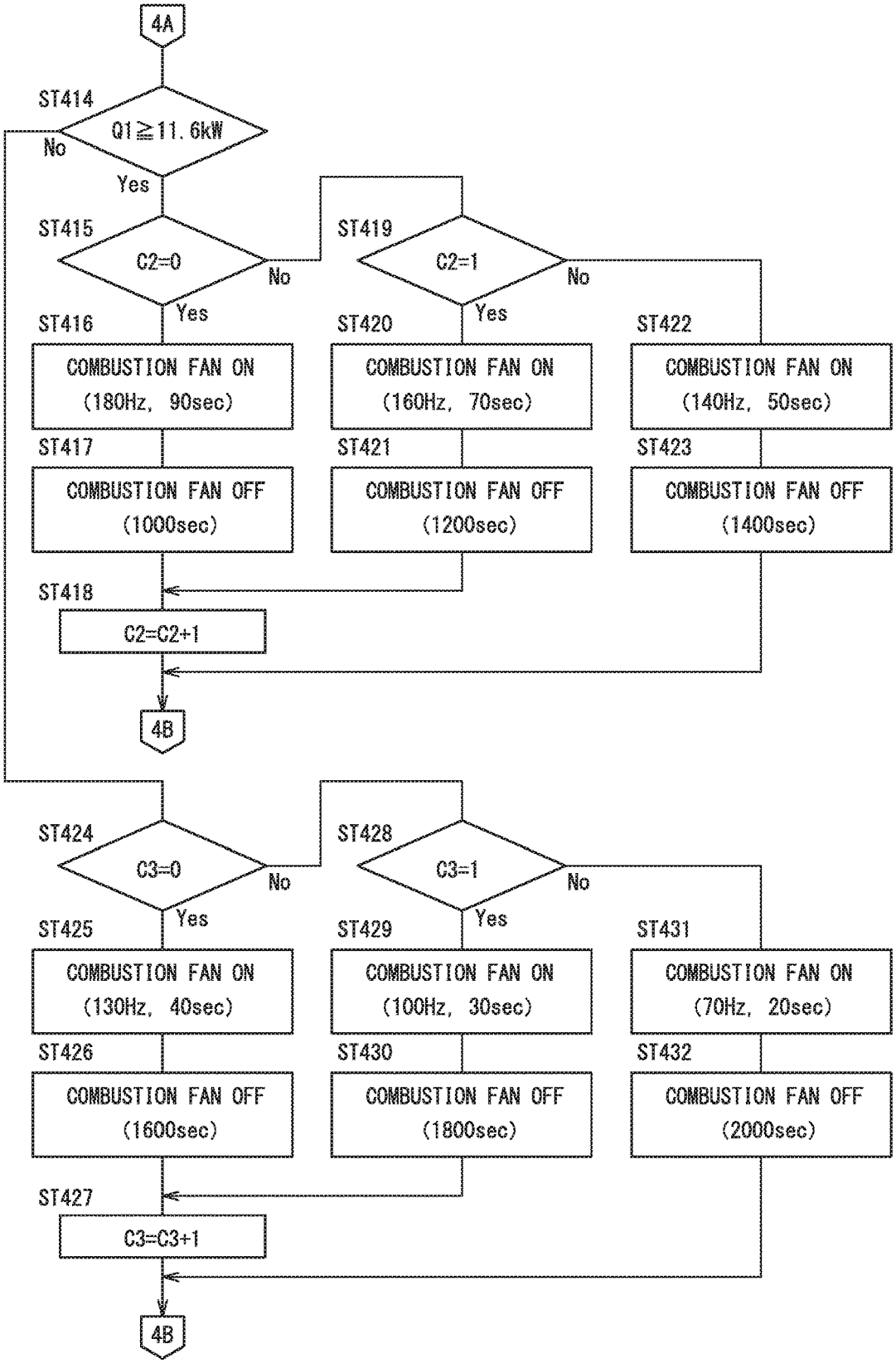
FIG. 9 is a partial operation flowchart after the combustion operation of the combustion apparatus stops in the fourth embodiment of the present invention.

FIGS. 8 and 9 are flowcharts showing control operation after the combustion operation of the water heater 1 according to the fourth embodiment of the present invention stops. In the water heater 1, although not shown, when the water supply to the hot water supplying terminal P is started and the burner 11 is ignited, a combustion heat amount per unit of time is calculated, and when the burner is extinguished, the integrated combustion heat amount Q1 of the burner 11 for the predetermined period of time (here, 10 minutes) before the extinction is calculated.

When the water supply to the hot water supplying terminal P is stopped during the combustion operation and the burner 11 is extinguished, the post-purge operation is performed as in the third embodiment. As a result, if the heat exchanger temperature T1 becomes lower than the reference temperature Ts, the intermittent blower operation is not performed, and numbers of activation C1, C2, C3 of the combustion fan 13 in respective predetermined combustion conditions, which are stored in the memory, are reset to "0". Moreover, the water heater 1 returns to the standby state for waiting for the resume of the water supply to the hot water supplying terminal P (ST401 to ST403).

On the other hand, at the time point when the post-purge operation ends, if the heat exchanger temperature T1 is the reference temperature Ts or higher (Yes in the step of ST402), the drain adhering to the surface of the heat exchanger 12 easily becomes the vapor. Therefore, the intermittent blower operation is performed in which the activation and the deactivation of the combustion fan 13 are repeated a plurality of times at the predetermined intervals. Specifically, if the heat exchanger temperature T1 is the reference temperature Ts or higher, it is further determined whether or not the integrated combustion heat amount Q1 at the time point when the end of the combustion operation is a first determination heat amount Qa (here, 34.9 kW) or higher (ST404).

If the integrated combustion heat amount Q1 is the first determination heat amount Qa or higher (Yes in the step of ST404), the amount of the drain adhering to the surface of the heat exchanger 12 is relatively large and the amount of the vapor generated therefrom is relatively large. Therefore, as in the steps from ST305 to ST313 in the third embodiment, the intermittent blower operation is performed while making the activation time of the combustion fan 13 shorter, the rotational speed lower, and the deactivation time longer in accordance with the increase in the number of activation (a first number of activation) C1 of the combustion fan 13 in a first combustion condition (ST405 to ST413).

On the other hand, if the integrated combustion heat amount Q1 is lower than the first determination heat amount Qa (No in the step ST404), but is a second determination heat amount Qb (here, 11.6 kW) or higher (Yes in the step ST414), which is lower than the first determination heat amount Qa, as in the steps from ST315 to ST323 in the third embodiment, the control circuit 3 sets the activation time of the combustion fan 13 to be shorter, the rotational speed to be lower, and the deactivation time to be longer by one level than the step of on/off operation in ST412 to ST413 to cause the combustion fan 13 to perform on/off operation. That is, the intermittent blower operation is performed while making the activation time of the combustion fan 13 shorter, the rotational speed lower, and the deactivation time longer in accordance with the increase in the number of activation (a second number of activation) C2 of the combustion fan 13 in a second combustion condition (ST415 to ST423).

Further, if the integrated combustion heat amount Q1 is lower than the second determination heat amount Qb (No in the step ST414), as in the steps from ST324 to ST332 in the third embodiment, the control circuit 3 sets the activation time of the combustion fan 13 to be shorter, the rotational speed to be lower, and the deactivation time to be longer by one level than the step of on/off operation in ST422 to ST423 to cause the combustion fan 13 to perform on/off operation. That is, the intermittent blower operation is performed while making the activation time of the combustion fan 13 shorter, the rotational speed lower, and the deactivation time longer in accordance with the increase in the number of activation (a third number of activation) C3 of the combustion fan 13 in a third combustion condition (ST424 to ST432).

According to the fourth embodiment, as the integrated combustion heat amount Q1 of the burner 11 for the predetermined period of time before the end of the combustion operation becomes lower, the deactivation time of the combustion fan 13 during the intermittent blower operation becomes the longer, the activation time becomes the shorter, and the rotational speed becomes the lower. Thus, as the water heater 1 according to the third embodiment, the hot water resupply performance is further enhanced. Moreover, the power consumption and the noise during the intermittent blower operation are significantly reduced.

In the above-described embodiments, after the post-purge operation ends, if the heat exchanger temperature T1 is the reference temperature Ts or higher, the intermittent blower operation is continuously started. However, the intermittent blower operation may be started after a predetermined standby time (e.g., 180 seconds) has passed since the post-purge operation ended. Moreover, in this case, the above-described standby time may be set to be larger, as the heat exchanger temperature T1 at the end time of post-purge operation is lower, as the combustion time F1 of the burner 11 during the combustion operation is shorter, or as the integrated combustion heat amount Q1 of the burner 11 is lower. Since this further shortens the activation time of the combustion fan 13, the power consumption and the noise during the intermittent blower operation can be reduced more.

Moreover, according to each of the above-described embodiments, in the intermittent blower operation, every time the activation and the deactivation of the combustion fan 13 are repeated, the activation time of the combustion fan 13 is set to be shorter, the rotational speed is set to be lower, and the deactivation time is set to be longer. However, every time the activation and the deactivation of the combustion fan 13 are repeated, at least one of the deactivation time, the rotational speed, and the activation time of the combustion fan 13 may be changed.

Moreover, in each of the embodiments, the temperature of the heat exchanger 12 is detected from the temperature of the hot water outlet pipe line 27 (a hot water outlet temperature). However, the temperature of the heat exchanger 12 may be detected from a temperature such as a surface temperature of the heat transfer fin 120, a temperature around an outlet side of the sensible heat exchanging pipe line 12A, a temperature around an outlet side of the latent heat exchanging pipe line 12B, a surface temperature of a peripheral wall of the heat exchange chamber 22, and the like The present invention can be also applied to a water heater without the check valve 15 at the air introduction port 211 of the combustion chamber 21. Moreover, the present invention is not limited to a combustion apparatus only having a hot-water supply function, and can be applied to a combustion apparatus having a bathwater reheating function. Moreover, the present invention can be applied to a heat source device for a room heater circulating hot water to a hot water heating terminal, a heat source device of a storage type water heater, or a heat source device only having a sensible heat exchanger.

As described in detail, the present invention is summarized as follows.

According to one aspect of the present invention, there is provided a combustion apparatus comprising:

a housing accommodating a burner configured to burn combustion gas and a heat exchanger configured to recover heat in combustion exhaust gas generated by the burner to heat water supplied from a water supply source;

a combustion fan configured to supply air for combustion of the burner into the housing, the heat exchanger being disposed below the burner inside the housing, and the combustion exhaust gas from the burner being supplied to the heat exchanger from above;

a post-purge operation-executing section configured to activate the combustion fan for a predetermined period of time after combustion operation of the burner stops; and an intermittent blower operation-executing section configured to repeat activation and deactivation of the combustion fan a plurality of times at predetermined intervals after the post-purge operation ends.

In the downward combustion type combustion apparatus, after the post-purge operation ends, the vapor generated around the heat exchanger ascends inside the housing slowly. Therefore, as the above-described intermittent blower operation, even if the combustion fan is deactivated for a certain period of time after the combustion fan is activated, the vapor hardly reaches to an upstream side of the burner in a short time. Further, since the combustion fan is deactivated at the predetermined intervals, the excessive cooling of the water inside the heat exchanger can be prevented. This not only can make shorter the time lag till the hot water at the predetermined temperature is supplied to the hot water supplying terminal, but can prevent freezing of the water inside the heat exchanger. Moreover, since the activation time of the combustion fan required for the backflow prevention of the vapor is shortened, the power consumption and the noise during the intermittent blower operation are reduced.

Preferably, the combustion apparatus further comprises, a blowing stop operation-executing section configured to stop the intermittent blower operation when a temperature of the heat exchanger becomes lower than a predetermined reference temperature in the intermittent blower operation.

As the temperature of the heat exchanger becomes lower, the amount of the vapor generated around the heat exchanger is decreased. Thus, according to the combustion apparatus described above, when the temperature of the heat exchanger becomes lower than the predetermined reference temperature in the intermittent blower operation, the intermittent blower operation is stopped to stop blowing into the housing thereafter. Thereby, the excessive cooling of the water inside the heat exchanger can more surely be prevented. Thus, it not only can make further shorter the time lag till the hot water at the predetermined temperature is supplied to the hot water supplying terminal, but can prevent freezing of the water inside the heat exchanger securely. Moreover, since the activation time of the combustion fan is further shortened, the power consumption and the noise during the intermittent blower operation are significantly reduced.

Preferably, the combustion apparatus further comprises, a first blowing interval-setting section configured to set a deactivation time of the combustion fan to be gradually longer than that at initial deactivation in the intermittent blower operation.

After the end of the post-purge operation, the amount and the ascending speed of the vapor generated around the heat exchanger are decreased, as the temperature of the heat exchanger becomes lower. On the other hand, in the combustion apparatus described above, since every time the activation and the deactivation of the combustion fan are repeated, the deactivation time of the combustion fan is set to be longer, the excessive cooling of the water inside the heat exchanger can more surely be prevented. Thus, according to the combustion apparatus, it not only can make further shorter the time lag till the hot water at the predetermined temperature is supplied to the hot water supplying terminal, but can prevent freezing of the water inside the heat exchanger securely. Moreover, since the activation time of the combustion fan is further shortened, the power consumption and the noise during the intermittent blower operation are significantly reduced.

Preferably, the combustion apparatus further comprises, a first blowing amount-setting section configured to set an activation time of the combustion fan to be gradually shorter than that at initial activation, and/or to set a rotational speed of the combustion fan to be gradually lower than that at the initial activation in the intermittent blower operation.

After the end of the post-purge operation, the amount and the ascending speed of the vapor generated around the heat exchanger are decreased, as the temperature of the heat exchanger becomes lower. On the other hand, in the combustion apparatus described above, since every time the activation and the deactivation of the combustion fan are repeated, the activation time of the combustion fan is set to be shorter and/or the rotational speed of the combustion fan is set to be lower, the excessive cooling of the water inside the heat exchanger can more surely be prevented. Thus, according to the combustion apparatus, it not only can make further shorter the time lag till the hot water at the predetermined temperature is supplied to the hot water supplying terminal, but can prevent freezing of the water inside the heat exchanger securely. Moreover, since an amount of the activation of the combustion fan becomes lower, the power consumption and the noise during the intermittent blower operation are significantly reduced.

Preferably, the combustion apparatus further comprises, at least one of a second blowing interval-setting section configured to set the deactivation time of the combustion fan to be longer as the temperature of the heat exchanger is lower, and a second blowing amount-setting section configured to set the activation time of the combustion fan to be shorter and/or to set the rotational speed of the combustion fan to be lower as the temperature of the heat exchanger is lower, in the intermittent blower operation.

After the end of the post-purge operation, the amount and the ascending speed of the vapor generated around the heat exchanger are decreased, as the temperature of the heat exchanger becomes lower. On the other hand, in the combustion apparatus described above, since as the temperature of the heat exchanger is lower, at least one of a longer deactivation time of the combustion fan, a shorter activation time of the combustion fan, and a lower rotational speed of the combustion fan is set, the excessive cooling of the water inside the heat exchanger can more surely be prevented. Thus, according to the combustion apparatus, it not only can make further shorter the time lag till the hot water at the predetermined temperature is supplied to the hot water supplying terminal, but can prevent freezing of the water inside the heat exchanger securely. Moreover, since the amount of the activation of the combustion fan becomes lower, the power consumption and the noise during the intermittent blower operation are significantly reduced.

Preferably, the combustion apparatus further comprises, at least one of a third blowing interval-setting section configured to set the deactivation time of the combustion fan to be longer as a combustion time of the burner during the combustion operation is shorter, and a third blowing amount-setting section configured to set the activation time of the combustion fan to be shorter and/or to set the rotational speed of the combustion fan to be lower as the combustion time of the burner during the combustion operation is shorter, in the intermittent blower operation.

As the combustion time of the burner during the combustion operation is shorter, the amount of the drain generated on the surface of the heat exchanger is decreased. Thus, after the end of the post-purge operation, the amount and the ascending speed of the vapor generated around the heat exchanger are decreased in accordance with the combustion condition. On the other hand, in the combustion apparatus described above, since as the combustion time of the burner during the combustion operation is shorter, at least one of the longer deactivation time of the combustion fan, the shorter activation time of the combustion fan, and the lower rotational speed of the combustion fan is set, the excessive cooling of the water inside the heat exchanger can more surely be prevented. This not only can make further shorter the time lag till the hot water at the predetermined temperature is supplied to the hot water supplying terminal, but can prevent freezing of the water inside the heat exchanger securely. Moreover, since the amount of the activation of the combustion fan is further shortened, the power consumption and the noise during the intermittent blower operation are significantly reduced.

Preferably, the combustion apparatus further comprises, at least one of a fourth blowing interval-setting section configured to set the deactivation time of the combustion fan to be longer as an integrated combustion heat amount of the burner during the combustion operation is lower, and a fourth blowing amount-setting section configured to set the activation time of the combustion fan to be shorter and/or to set the rotational speed of the combustion fan to be lower as the integrated combustion heat amount of the burner during the combustion operation is lower, in the intermittent blower operation.

As the integrated combustion heat amount of the burner during the combustion operation is lower, the amount of the drain generated on the surface of the heat exchanger is decreased. Thus, after the end of the post-purge operation, the amount and the ascending speed of the vapor generated around the heat exchanger are decreased in accordance with the combustion condition. On the other hand, in the combustion apparatus described above, since as the integrated combustion heat amount of the burner during the combustion operation is lower, at least one of the longer deactivation time of the combustion fan, the shorter activation time of the combustion fan, and the lower rotational speed of the combustion fan is set, the excessive cooling of the water inside the heat exchanger can more surely be prevented. This not only can make further shorter the time lag till the hot water at the predetermined temperature is supplied to the hot water supplying terminal, but can prevent freezing of the water inside the heat exchanger securely. Moreover, since the amount of the activation of the combustion fan is further shortened, the power consumption and the noise during the intermittent blower operation are significantly reduced.

INDUSTRIAL APPLICABILITY

According to the present invention, a water heater excellent in superior hot water resupply performance, having low power consumption and low noise during operation can be provided.

The invention claimed is:

1. A combustion apparatus comprising:

a housing accommodating a burner configured to burn combustion gas and a heat exchanger configured to recover heat in combustion exhaust gas generated by the burner to heat water supplied from a water supply source, the heat exchanger being disposed below the burner inside the housing, and the combustion exhaust gas from the burner being supplied to the heat exchanger from above;

a combustion fan configured to supply air for combustion of the burner into the housing;

a post-purge operation-executing section configured to activate the combustion fan for a predetermined period of time after combustion operation of the burner stops;

an intermittent blower operation-executing section configured to repeat activation and deactivation of the combustion fan a plurality of times at predetermined intervals after the post-purge operation ends;

a blowing stop operation-executing section configured to stop the intermittent blower operation when a temperature of the heat exchanger becomes lower than a predetermined reference temperature in the intermittent blower operation;

a first blowing interval-setting section configured to set a deactivation time of the combustion fan to be gradually longer than that at initial deactivation in the intermittent blower operation; and a first blowing amount-setting section configured to set an activation time of the combustion fan to be gradually shorter than that at initial activation, and/or to set a rotational speed of the combustion fan to be gradually lower than that at the initial activation the intermittent blower operation.

2. The combustion apparatus according to claim 1, further comprising:

at least one of a second blowing interval-setting section configured to set the deactivation time of the combustion fan at each deactivation to be longer than that at each previous deactivation as the temperature of the heat exchanger is lower, and a second blowing amount-setting section configured to set the activation time of the combustion fan at each activation to be shorter than that at each previous activation and/or to set the rotational speed of the combustion fan at each activation to be lower than that at each previous activation as the temperature of the heat exchanger is lower in the intermittent blower operation.

3. The combustion apparatus according to claim 1, further comprising:

at least one of a third blowing interval-setting section configured to set the deactivation time of the combustion fan at each deactivation to be longer than that at each previous deactivation as a combustion time of the burner during the combustion operation is shorter, and a third blowing amount-setting section configured to set the activation time of the combustion fan at each activation to be shorter than that at each previous activation and/or to set the rotational speed of the combustion fan at each activation to be lower than that at each previous activation as the combustion time of the burner during the combustion operation is shorter, in the intermittent blower operation.

4. The combustion apparatus according to claim 1, further comprising:

at least one of a fourth blowing interval-setting section configured to set the deactivation time of the combustion fan at each deactivation to be longer than that at each previous deactivation as an integrated combustion heat amount of the burner during the combustion operation is lower, and a fourth blowing amount-setting section configured to set the activation time of the combustion fan at each activation to be shorter than that at each previous activation and/or to set the rotational speed of the combustion fan at each activation to be lower than that at each previous activation as the integrated combustion heat amount of the burner during the combustion operation is lower, in the intermittent blower operation.

* * * * *